US011248409B2

(12) United States Patent
Makihira et al.

(10) Patent No.: US 11,248,409 B2
(45) Date of Patent: Feb. 15, 2022

(54) DOOR DRIVING DEVICE

(71) Applicant: NABTESCO CORPORATION, Tokyo (JP)

(72) Inventors: Ikuo Makihira, Tokyo (JP); Shinsuke Uchida, Tokyo (JP)

(73) Assignee: NABTESCO CORPORATION, Tokyo (JP)

( * ) Notice: Subject to any disclaimer, the term of this patent is extended or adjusted under 35 U.S.C. 154(b) by 90 days.

(21) Appl. No.: 16/715,811

(22) Filed: Dec. 16, 2019

(65) Prior Publication Data

US 2020/0208453 A1 Jul. 2, 2020

(30) Foreign Application Priority Data

Dec. 26, 2018 (JP) ..... JP2018-243657

(51) Int. Cl.
*E05F 15/56* (2015.01)
*E05F 15/50* (2015.01)
*E05F 3/12* (2006.01)

(52) U.S. Cl.
CPC ..... *E05F 15/565* (2015.01); *E05F 3/12* (2013.01); *E05F 15/50* (2015.01); *E05F 15/56* (2015.01); *E05Y 2900/531* (2013.01)

(58) Field of Classification Search
CPC ..... E05F 15/655; E05F 15/565; E05F 15/56; E05F 15/50; E05F 3/12; E05F 15/40; E05F 15/41; E05Y 2900/14; E05Y 2900/51; E06B 3/4654
See application file for complete search history.

(56) References Cited

U.S. PATENT DOCUMENTS 4,342,378 A * 8/1982 Hmelovsky ..... G05B 19/416 187/316
5,682,023 A * 10/1997 McHugh ..... G05D 3/12 187/295
5,893,236 A * 4/1999 Krbec ..... E05D 15/1068 49/118
6,189,265 B1 * 2/2001 Fink ..... E05D 15/1044 49/118
6,580,243 B2 * 6/2003 Itami ..... G05B 19/40 318/452
8,232,754 B2 * 7/2012 Ozaki ..... H02H 7/0851 318/400.15

(Continued)

FOREIGN PATENT DOCUMENTS

EP 1653035 A2 5/2006
JP 2016-159847 A 9/2016

OTHER PUBLICATIONS

Extended European Search Report dated May 29, 2020 issued in corresponding European Patent Application No. 19216980.3 (6 pgs.).

*Primary Examiner* — Justin B Rephann
(74) *Attorney, Agent, or Firm* — Pillsbury Winthrop Shaw Pittman, LLP

(57) ABSTRACT

A door driving device includes a driving unit driving a door that opens and closes an entrance of a vehicle having a door case, and a control unit controlling the driving unit such that the door moves with a discontinuous acceleration during a period from when the door starts to open to when the door moves at a constant speed in an opening direction in which the door is retracted into the door case.

6 Claims, 10 Drawing Sheets

(56) References Cited

U.S. PATENT DOCUMENTS

| | | | | |
|---|---|---|---|---|
| 8,890,452 | B2 * | 11/2014 | Ozaki | H02H 7/0854<br>318/400.15 |
| 9,056,749 | B2 * | 6/2015 | Utsunomiya | B66B 13/26 |
| 10,118,800 | B2 * | 11/2018 | Siikonen | B66B 13/146 |
| 2005/0228579 | A1 * | 10/2005 | Urman | E05F 15/50<br>701/124 |
| 2008/0263964 | A1 * | 10/2008 | Ludwig | B66B 13/146<br>49/506 |
| 2011/0126476 | A1 * | 6/2011 | Bertram | E06B 3/4654<br>49/506 |
| 2019/0128041 | A1 * | 5/2019 | Haberberger | E05F 15/627 |

* cited by examiner

DOOR DRIVING DEVICE

CROSS-REFERENCE TO RELATED APPLICATIONS

This application is based on and claims the benefit of priority from Japanese Patent Application Serial No. 2018-243657 (filed on Dec. 26, 2018), the contents of which are hereby incorporated by reference in its entirety.

TECHNICAL FIELD

The present invention relates to a door driving device driving a door that opens and closes an entrance of a vehicle.

BACKGROUND

In vehicles, a door of a vehicle that opens and closes for allowing passengers to board to or exit from the vehicle may sometime catch an object or people when the door is closed. A door catching detection device for detecting such door catching has been proposed (for example, see Japanese Laid-Open Patent Publication No. 2016-159847). When an occurrence of door catching is detected by the door catching detection device, the door is opened to dissolve the door catching state and is then closed again to allow the vehicle to start running.

In addition to the door catching that occurs when the door of the vehicle is closed, there may be a case where a finger or an object is caught between the door and a door case when the door is opened. To prevent such finger catching by the door, a warning sticker or the like is provided on the door in order to call for passengers' attention to mind their fingers near the door. However passengers may not notice such warning when they concentrate on something else. If the finger catching occurs, the door is unable to be fully opened, and it may take time to eliminate the finger catching state. Therefore it is required to prevent the occurrence of finger catching.

SUMMARY

In view of the above, one object of the present invention is to provide a door driving device that can prevent the occurrence of finger catching where an object or a finger is caught between a door and a door case.

According to one aspect of the invention to solve the above-mentioned problem, provided is a door driving device. The door driving device includes a driving unit driving a door that opens and closes an entrance of a vehicle having a door case, and a control unit controlling the driving unit such that the door moves with a discontinuous acceleration during a period from when the door starts to open to when the door moves at a constant speed in an opening direction in which the door is retracted into the door case.

Since the door moves with a discontinuous acceleration when the door is opened, passengers can easily notice opening of the opening movement of the door. Therefore, it is possible to prevent the occurrence of finger catching where an object or a finger gets caught between the door leaf and the door case.

In the door driving device, the control unit may control the driving unit such that the door is moved in the opening direction as a first action, and thereafter the control unit may control the driving unit such that the movement of the door is decelerated, stopped, or decelerated and stopped as a second action thereby the door moves with the discontinuous acceleration.

In this case, the movement of the door is decelerated, stopped, or decelerated and stopped as the second action, which causes a change in the opening movement of the door so that passengers can easily notice the opening movement of the door.

In the door driving device, the control unit may control the driving unit such that an acceleration of the door in the first action in the opening direction is larger than an acceleration of the door in the opening direction after the second action is performed.

In this case, since the acceleration of the door in the first action in the opening direction is larger than the acceleration of the door in the opening direction after the second action, passengers can easily notice the opening movement of the door.

In the door driving device, the driving unit may include a cylinder. The cylinder includes a piston that drives the door to be opened or closed, a first pressure chamber that drives the piston such that the door is moved in the opening direction, and a second pressure chamber that drives the piston such that the door is moved in a closing direction opposite to the opening direction. The driving unit may further include a first switching valve through which air is supplied to the first pressure chamber, and a second switching valve through which air is supplied to the second pressure chamber. The control unit may control the driving unit such that the second switching valve discharges the air from the second pressure chamber while the first switching valve supplies the air to the first pressure chamber in order to move the door in the opening direction as the first action, and thereafter the control unit may control the driving unit such that the second switching valve supplies the air to the second pressure chamber in order to decelerate, stop, or decelerate and stop the movement of the door as the second action.

In this case, by moving the piston via the first switching valve and the second switching valve, opening and closing movements of the door are realized, and it is also possible to move the door in the opening direction with a discontinuous acceleration.

In the door driving device, the control unit may cause the first switching valve to discharge the air from the first pressure chamber and may cause the second switching valve to discharge the air from the second pressure chamber before performing the first action.

In this case, since the air in the second pressure chamber is exhausted before the first action, the door can be moved with a high acceleration by supplying the air to the first pressure chamber in the first action.

In the door driving device, the control unit may cause the first switching valve to discharge the air from the first pressure chamber and cause the second switching valve to supply the air to the second pressure chamber when the movement of the door is decelerated, stopped, or decelerated and stopped as the second action.

In this case, in the second action, the air is discharged from the first pressure chamber that moves the door in the opening direction, and the air is supplied to the second pressure chamber that moves the door in the closing direction. Therefore, the second action in which the movement of the door is decelerated, stopped, or decelerated and stopped can be performed in a short amount of time without hindering the movement of the piston in the second action.

In the door driving device, air with a same pneumatic pressure is supplied to the first switching valve and the second switching valve. The driving unit may further include a pressure reducing valve that reduces a pressure of the air supplied to the first pressure chamber via the first switching valve.

In this case, it is possible to make the force that moves the piston in the closing direction larger than the force that moves the piston in the opening direction Therefore, even if the air is supplied to both the pressure chambers, the door can be kept closed.

DESCRIPTION OF THE EMBODIMENTS

With reference to FIGS. 1 to 10, an embodiment of a door equipped with a door driving device will be now described. The door driving device is provided for each door that opens and closes an entrance of a vehicle such as a railway vehicle.

Figure 1:
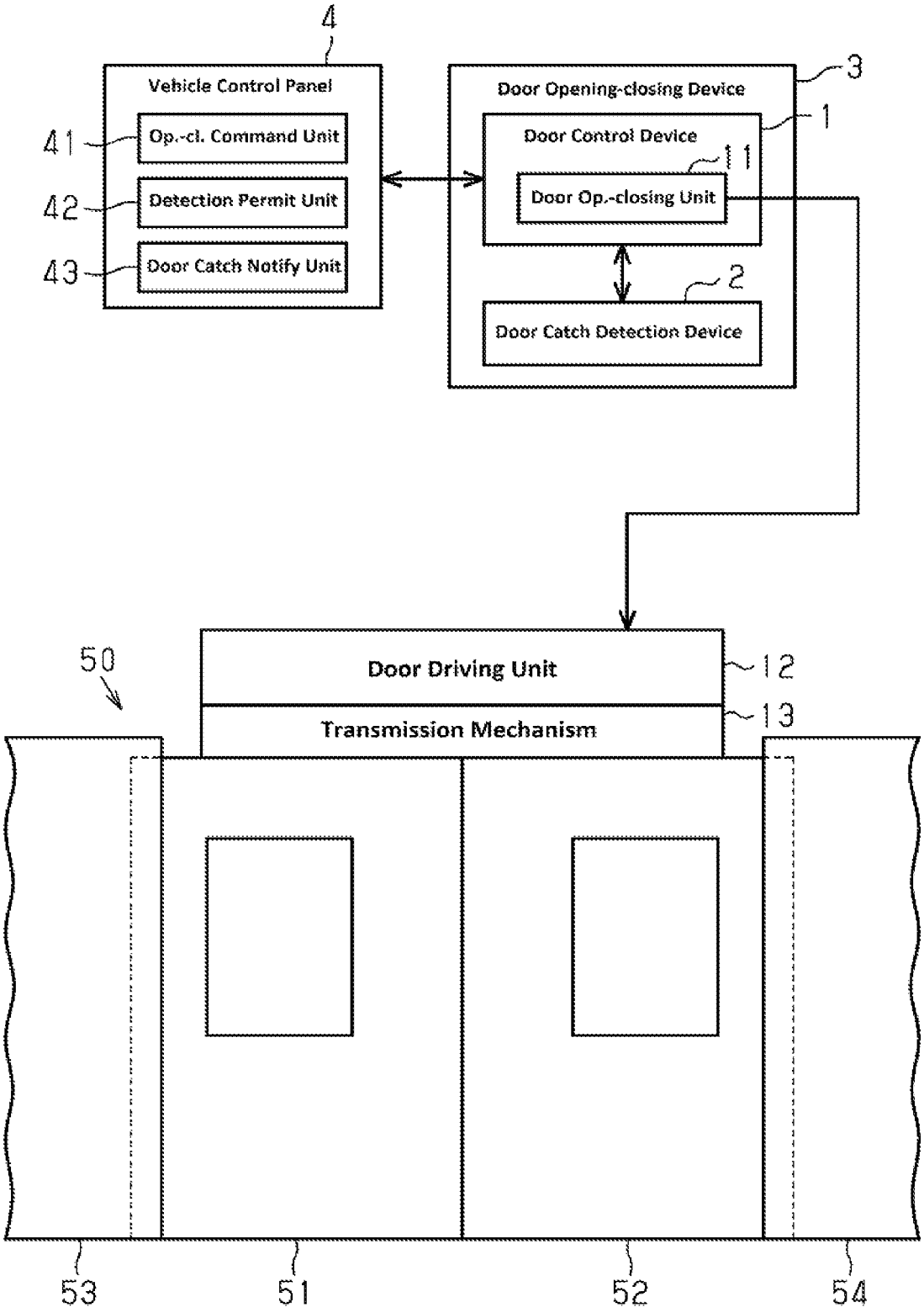
FIG. 1 is a block diagram showing a schematic configuration of a door driving device according to one embodiment of the invention.

As shown in FIG. 1, a door device 50 of the vehicle is a bi-parting door set including a first door leaf 51 on the left side in the drawing and a second door leaf 52 on the right side in the drawing. The vehicle has a first door case 53 that houses the first door leaf 51 and a second door case 54 that houses the second door leaf 52. The entrance is opened when the first door leaf 51 is retracted into the first door case 53, and the entrance is closed when the first door leaf 51 is pulled out from the first door case 53. The entrance is opened when the second door leaf 52 is retracted into the second door case 54, and the entrance is closed when the second door leaf 52 is pulled out from the second door case 54.

The door device 50 includes a door driving unit 12 that drives the first door leaf 51 and the second door leaf 52, and a transmission mechanism 13 that transmits the driving force of the door driving unit 12 to the first door leaf 51 and the second door leaf 52. The door driving unit 12 includes a pneumatic cylinder. The first door leaf 51 and the second door leaf 52 are moved to open or close through operation of the pneumatic cylinder. The transmission mechanism 13 transmits the driving force of the door drive unit 12 through, for example, a rack and pinion mechanism or a transmission belt. The door device 50 is controlled by the door control device 1. The door control device 1 opens and closes the first door leaf 51 and the second door leaf 52 by controlling the door driving unit 12. The door driving device is a device that includes the door control device 1 and the door driving unit 12 and drives the first door leaf 51 and the second door leaf 52 to open and close the entrance of the vehicle.

The door device 50 is provided with a door catching detection device 2 that detects that an object and the like is caught between the first door leaf 51 and the second door leaf 52. The door catching detection device 2 is electrically coupled to the door control device 1 and is communicably interconnected thereto. The door control device 1 is also electrically coupled to a vehicle control panel 4 installed in a driver's cab or the like that controls the vehicle, and is communicably interconnected thereto. A device including the door control device 1 and the door catching detection device 2 is herein referred to as a door opening-closing device 3.

The door control device 1 includes a door opening-closing unit 11 as a control unit that controls opening and closing operations of the first door leaf 51 and the second door leaf 52. The door opening-closing unit 11 controls driving of the pneumatic cylinder through air pressure of a compressor (not shown) to move the first door leaf 51 and the second door leaf 52 between a fully open state and a fully closed state. When the door opening-closing unit 11 closes the first door leaf 51 and the second door leaf 52, the door opening-closing unit 11 receives a detection signal from a door closing switch (not shown) that detects that the first door leaf 51 and the second door leaf 52 have been closed. When the door opening-closing unit 11 received the detection signal, the door opening-closing unit 11 ends a "closing operation."

The vehicle control panel 4 includes an opening-closing command unit 41 that instructs the door control device 1 to cause the door device 50 to be opened or closed, a detection permission unit 42 that permits detection of door catching, and a door catching notification unit 43 that notifies an occurrence of the door catching. The opening-closing command unit 41 is operated by a conductor or a driver, and outputs an opening command or a closing command to the door control device 1. When the opening command is supplied to the door control device 1, the door control device 1 causes the door opening-closing unit 11 to move the first door leaf 51 and the second door 52 leaf in a door opening direction such that the first door leaf 51 and the second door leaf 52 are retracted into the first door case 53 and the second door case 54 respectively. When a closing command is suppled to the door control device 1, the door control device 1 causes the door opening-closing unit 11 to move the first door leaf 51 and the second door 52 leaf in a door closing direction opposite to the opening direction such that the first door leaf 51 and the second door leaf 52 are pulled out from the first door case 53 and the second door case 54 respectively. The detection permission unit 42 is operated by the conductor or the driver. The detection permission unit 42 outputs a detection command when detection of door catching is performed, and does not output the detection command when the detection of door catching is not performed. When the door catching detection device 2 detected a door catching, the door catching notification unit 43 turns on a light provided on the vehicle control panel 4 or displays information to indicate the occurrence of the door catching.

The door driving unit 12 of the door driving device will now be described with reference to FIG. 2.

Figure 2:
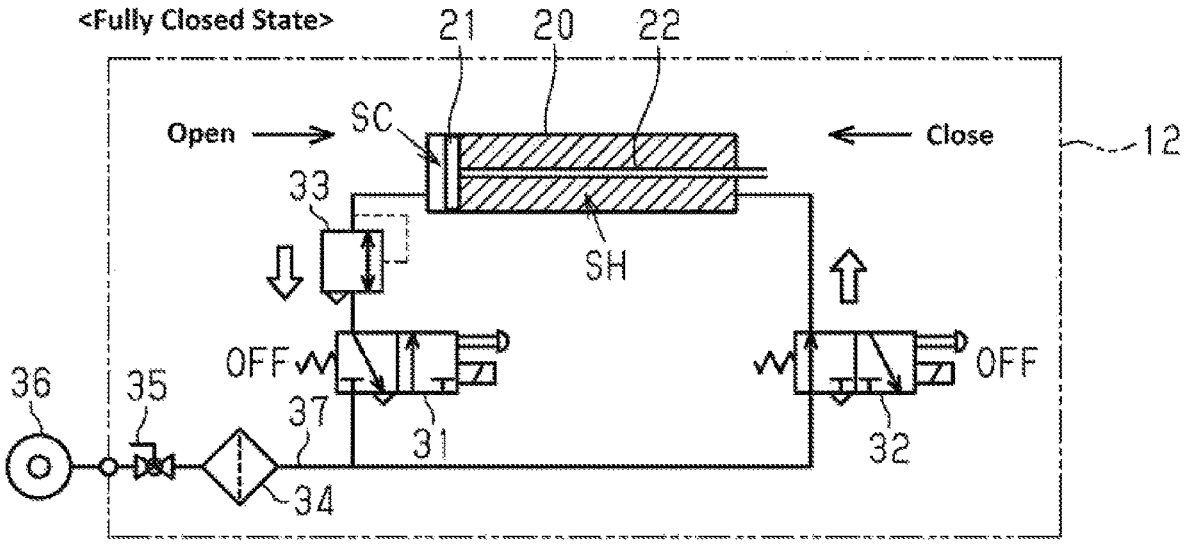
FIG. 2 is an air circuit diagram of the door driving device of the embodiment when a door is fully closed.

As shown in FIG. 2, the door driving unit 12 includes a cylinder 20. The cylinder 20 includes a piston 21, a first pressure chamber SC that drives the piston 21 such that the first door leaf 51 and the second door leaf 52 move in the opening direction, and a second pressure chamber SH that drives the piston 21 such that the first door leaf 51 and the second door leaf 52 move in the closing direction. A rod 22 is fixed to the piston 21. The rod 22 is fixed to a side of the piston 21 closer to the second pressure chamber SH. Thus, the piston 21 is driven in the closing direction of the first door leaf 51 and the second door leaf 52 when the air with the same pressure is supplied to both the first pressure chamber SC and the second pressure chamber SH. The rod 22 is coupled to the transmission mechanism 13. Action of the piston 21 is transmitted to the transmission mechanism 13 via the rod 22. Thereby the piston 21 opens and closes the first door leaf 51 and the second door leaf 52.

The door driving unit 12 includes a first switching valve 31 through which the air is supplied to the first pressure chamber SC and a second switching valve 32 through which the air is supplied to the second pressure chamber SH. The first switching valve 31 and the second switching valve 32 are electromagnetic valves that each have three ports and two switching positions. The first switching valve 31 and the second switching valve 32 are coupled to a same air source 36. The first switching valve 31 is a normally-closed electromagnetic valve that passes the air supplied from the air source 36 to the first pressure chamber SC when energized (ON), and discharges the air from the first pressure chamber SC when de-energized (OFF). The second switching valve 32 is a normally-opened electromagnetic valve that passes the air supplied from the air source 36 to the second pressure chamber SH when de-energized (OFF), and discharges the air from the second pressure chamber SH when energized (ON). The first switching valve 31, the second switching valve 32, and the air source 36 are coupled to each other through a connection channel 37. The connection channel 37 is coupled to the air source 36 and branches off to be coupled to the first switching valve 31 and the second switching valve 32 respectively. A filter 34 that removes foreign substances contained in the air supplied from the air source 36 is provided in a portion of the connection channel 37 where is not branched. The connection channel 37 between the filter 34 and the air source 36 is provided with a door cock 35 that switches between passage and blocking of the air. When the door cock 35 is operated to cut off the supply of the air from the air source 36, the first door leaf 51 and the second door leaf 52 are released and they can be moved manually. A pressure reducing valve 33 is provided between the first switching valve 31 and the first pressure chamber SC. Even when the air of the same pressure is supplied from the same air source 36 to the first switching valve 31 and the second switching valve 32, the pressure in the first pressure chamber SC becomes lower than the pressure in the second pressure chamber SH by the pressure reducing valve 33. The first switching valve 31 and the second switching valve 32 are electrically connected to the door opening-closing unit 11 and are operated by switching between energization and non-energization by the door opening-closing unit 11.

As shown in FIG. 2, when the first door leaf 51 and the second door 52 leaf are in the "fully closed state," the first switching valve 31 is de-energized (OFF) to discharge the air from the first pressure chamber SC, and the second switching valve 32 is de-energized (OFF) to supply the air to the second pressure chamber SH. Consequently, the piston 21 is maintained at the closed position after the piston has moved in the closing direction, and the first door leaf 51 and the second door leaf 52 are maintained in the closed state.

Next, a door opening process for opening the first door leaf 51 and the second door leaf 52 by the door control device 1 will be described with reference to FIGS. 3 to 8. The door opening process is a process of moving the first door leaf 51 and the second door leaf 52 from the fully closed state to the fully open state, and corresponds to the whole of the opening movement.

In the door opening process, the door control device 1 performs a "preliminary action" in which the first door leaf 51 and the second door leaf 52 move with a discontinuous acceleration in order to prevent the occurrence of finger catching where an object or a finger is caught between the first door leaf 51 (second door leaf 52) and the first door case 53 (second door case 54). The "preliminary action" is performed during a period from when the first door leaf 51 and the second door leaf 52 start to open to when the first door leaf 51 and the second door leaf 52 move in the opening direction at a constant speed. In the "preliminary action," the "second action" in which the first door leaf 51 and the second door leaf 52 are decelerated and stopped is performed after the "first action" in which the first door leaf 51 and the second door leaf 52 are moved in the opening direction. Consequently the first door leaf 51 and the second door leaf 52 move with a discontinuous acceleration. The door opening-closing unit 11 performs the "preliminary action." Alternatively only the door control device 1 may serve as the door driving device.

Figure 3:
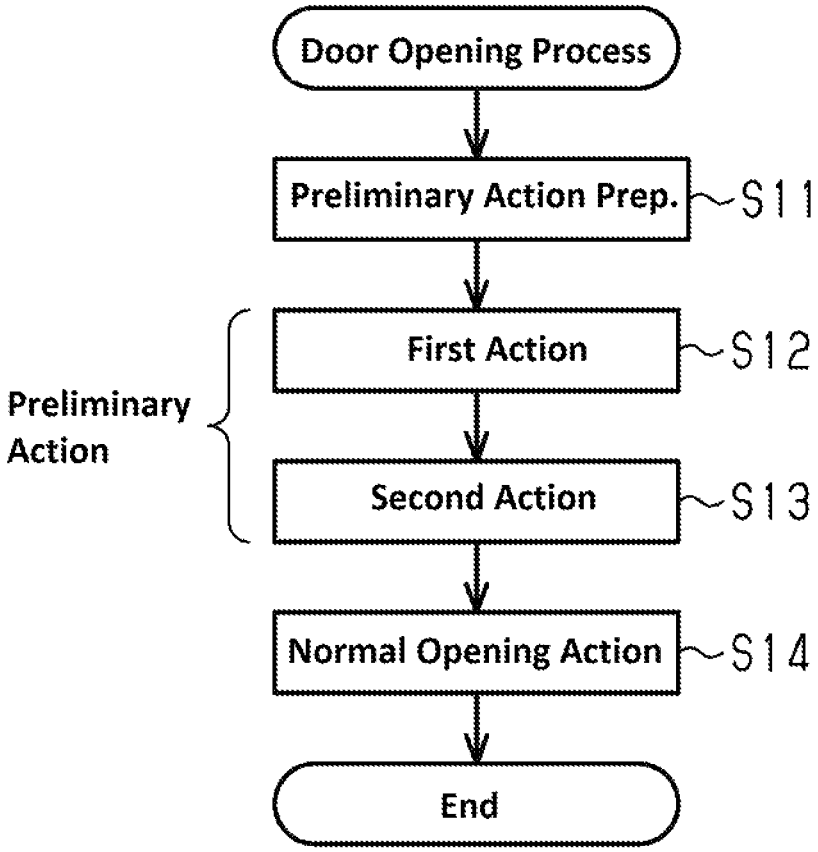
FIG. 3 is a flow chart showing a door opening process of the door driving device of the embodiment.

Referring to FIG. 3, the door control device 1 performs a "preliminary action preparation" (step S11). In the "preliminary action preparation," the first switching valve 31 and the second switching valve 32 exhaust the air from the first pressure chamber SC and the second pressure chamber SH respectively before performing the preliminary action. Specifically, the door opening-closing unit 11 de-energizes (OFF) the first switching valve 31 and energizes (ON) the second switching valve 32.

Figure 4:
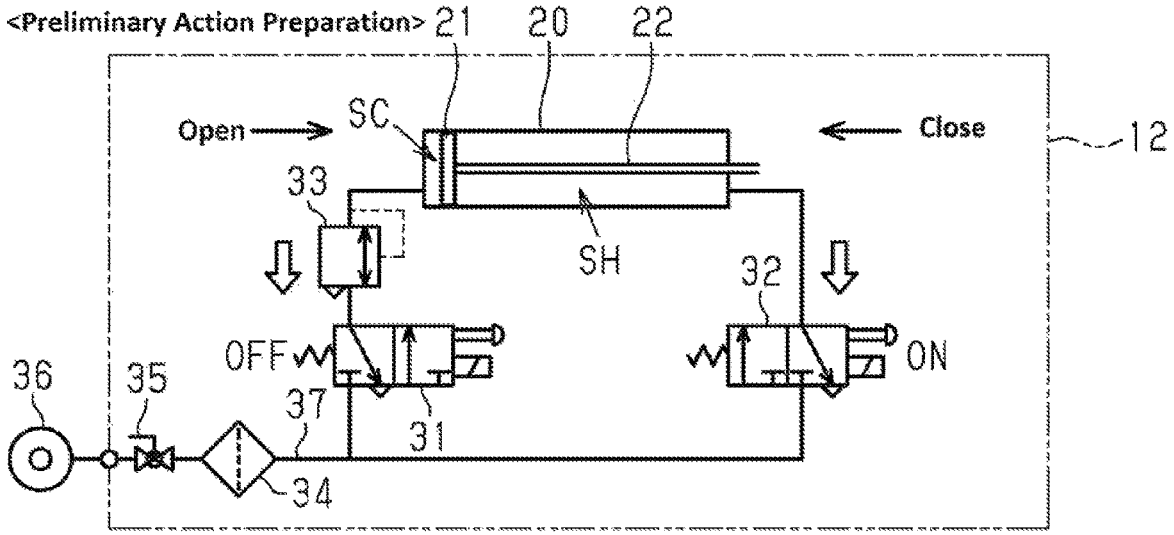
FIG. 4 is an air circuit diagram for describing preliminary action preparation performed by the door driving device of the embodiment.

As shown in FIG. 4, in the "preliminary action preparation," the first switching valve 31 is de-energized (OFF) to discharge the air from the first pressure chamber SC, and the second switching valve 32 is energized (ON) to discharge the air from the second pressure chamber SH. Here, since the piston 21 is not forced on either side, the piston 21 is maintained at the position where the door is in the fully closed state. Accordingly, the first door leaf 51 and the second door leaf 52 are maintained in the closed state.

Subsequently, as illustrated in FIG. 3, the door control device 1 performs the "first action" of the "preliminary action" (step S12). In the "first action," the first switching valve 31 supplies the air to the first pressure chamber SC while the second switching valve 32 discharges the air from the second pressure chamber SH thereby the piston 21 is moved in the opening direction. That is, the door opening-closing unit 11 energizes the first switching valve 31 (ON) and energizes (ON) the second switching valve 32.

Figure 5:
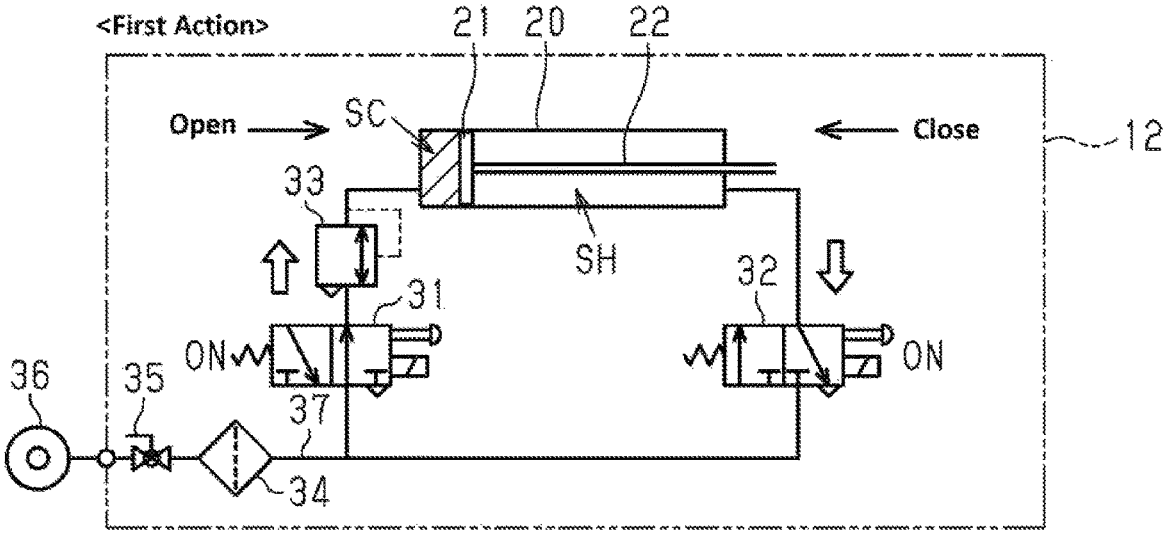
FIG. 5 is an air circuit diagram for describing a first action performed by the door driving device of the embodiment.

As shown in FIG. 5, in the "first action," the first switching valve 31 is energized (ON) to supply the air to the first pressure chamber SC from the air source 36, and the second switching valve 32 is energized (ON) to discharge the air from the second pressure chamber SH. Thus only the first pressure chamber SC side of the piston 21 is forced and is moved swiftly in the opening direction.

Subsequently, as illustrated in FIG. 3, the door control device 1 performs the "second action" of the "preliminary action" (step S13). In the "second action," the second switching valve 32 supplies the air to the second pressure chamber SH to stop the first door leaf 51 and the second door leaf 52 after the "first action." That is, the door opening-closing unit 11 energizes the first switching valve 31 (ON) and de-energizes the second switching valve 32 (OFF).

Figure 6:
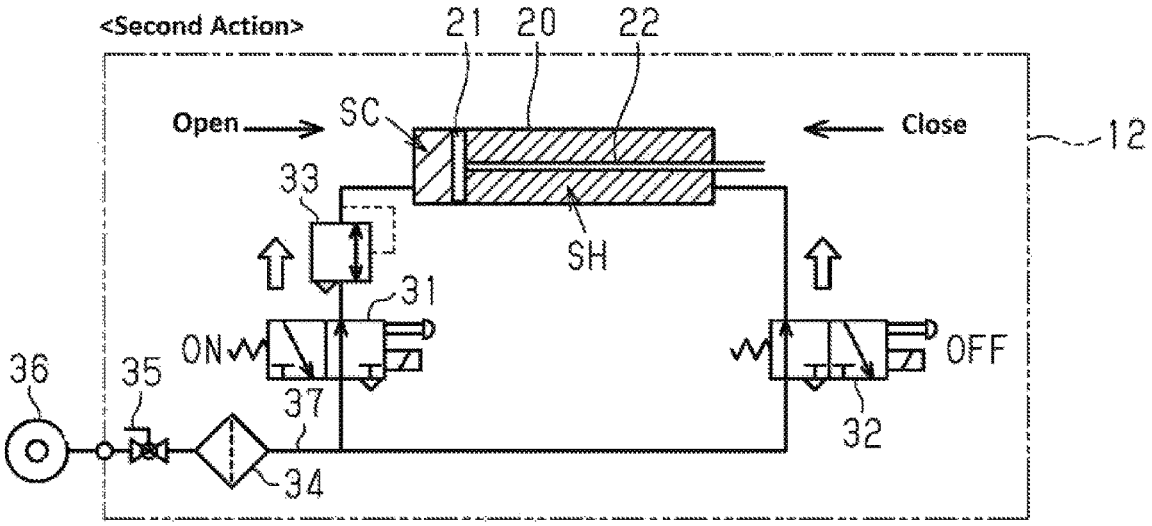
FIG. 6 is an air circuit diagram for describing a second action performed by the door driving device of the embodiment.

As shown in FIG. 6, in the "second action," the first switching valve 31 is energized (ON) to supply the air to the first pressure chamber SC from the air source 36, and the second switching valve 32 is de-energized (OFF) to supply the air to the second pressure chamber SH. Thereby both sides of the piston 21 are forced so that the piston 21 is maintained in that position, and the movement of the piston in the opening direction is stopped.

Subsequently, as illustrated in FIG. 3, the door control device 1 performs a "normal opening action" (step S14). In the "normal opening action," the second switching valve 32 discharges the air from the second pressure chamber SH to allow the first door leaf 51 and the second door leaf 52 to move in the opening direction after the "second action." That is, the door opening-closing unit 11 energizes the first switching valve 31 (ON) and energizes (ON) the second switching valve 32.

Figure 7:
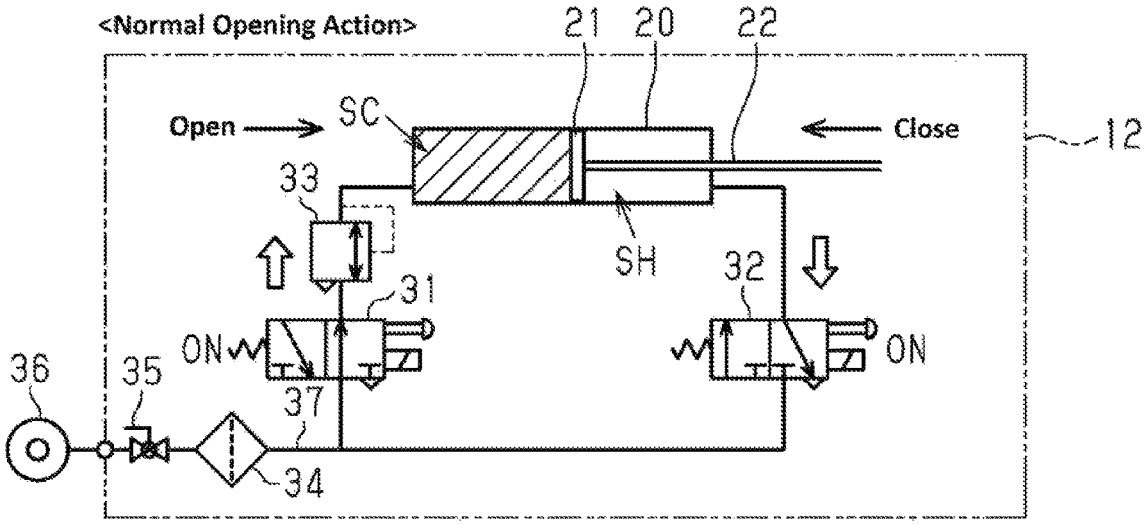
FIG. 7 is an air circuit diagram for describing a normal opening action performed by the door driving device of the embodiment.

As shown in FIG. 7, in the "normal opening action," the first switching valve 31 is energized (ON) to supply the air to the first pressure chamber SC from the air source 36, and the second switching valve 32 is energized (ON) to discharge the air from the second pressure chamber SH. Since only the first pressure chamber SC side of the piston 21 is forced so that the piston moves in the direction where the first door leaf 51 and the second door leaf 52 open. Then, the door opening-closing unit 11 ends the door opening process while the state of the "normal opening action" is maintained.

Figure 8:
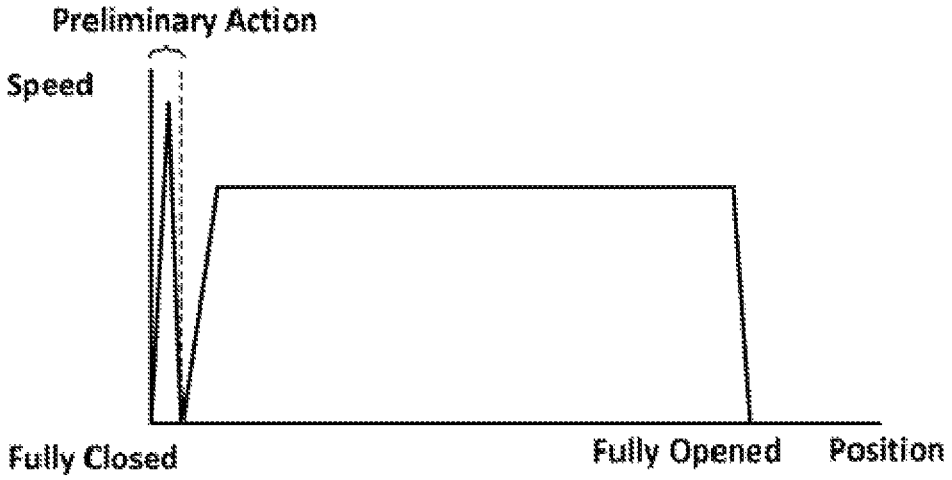
FIG. 8 is a graph showing change in the speed of the door opening process of the door driving device of the embodiment.

FIG. 8 illustrates a relationship between the position and speed of the first door leaf 51 and the second door leaf 52 in the door opening process. The first door leaf 51 and the second door leaf 52 temporarily perform the "preliminary action" when starting to move in the opening direction from the fully closed state, and perform the "normal opening action" after the "preliminary action." A speed of the "first action" that starts to move the first door leaf 51 and the second door leaf 52 in the opening direction in the "preliminary action" is higher than a speed of the "normal opening action." Further, an acceleration of the "first action" is higher than an acceleration of the "normal opening action." In the "preliminary action," the "second action" decelerates and stops the first door leaf 51 and the second door leaf 52. After the "second action" is stopped, the "normal opening action" is performed.

A door closing process for closing the first door leaf 51 and the second door leaf 52 by the door control device 1 will be now described with reference to FIGS. 9 to 11. The door closing process is a process of moving the first door leaf 51 and the second door leaf 52 from the fully opened state to the fully closed state.

The door control device 1 checks whether the door catching detection is performed or not during the door closing process when the first door leaf 51 and the second door leaf 52 are closed in order to prevent the occurrence of door catching in which an object is caught between the first door leaf 51 and the second door 52 leaf.

Figure 9:
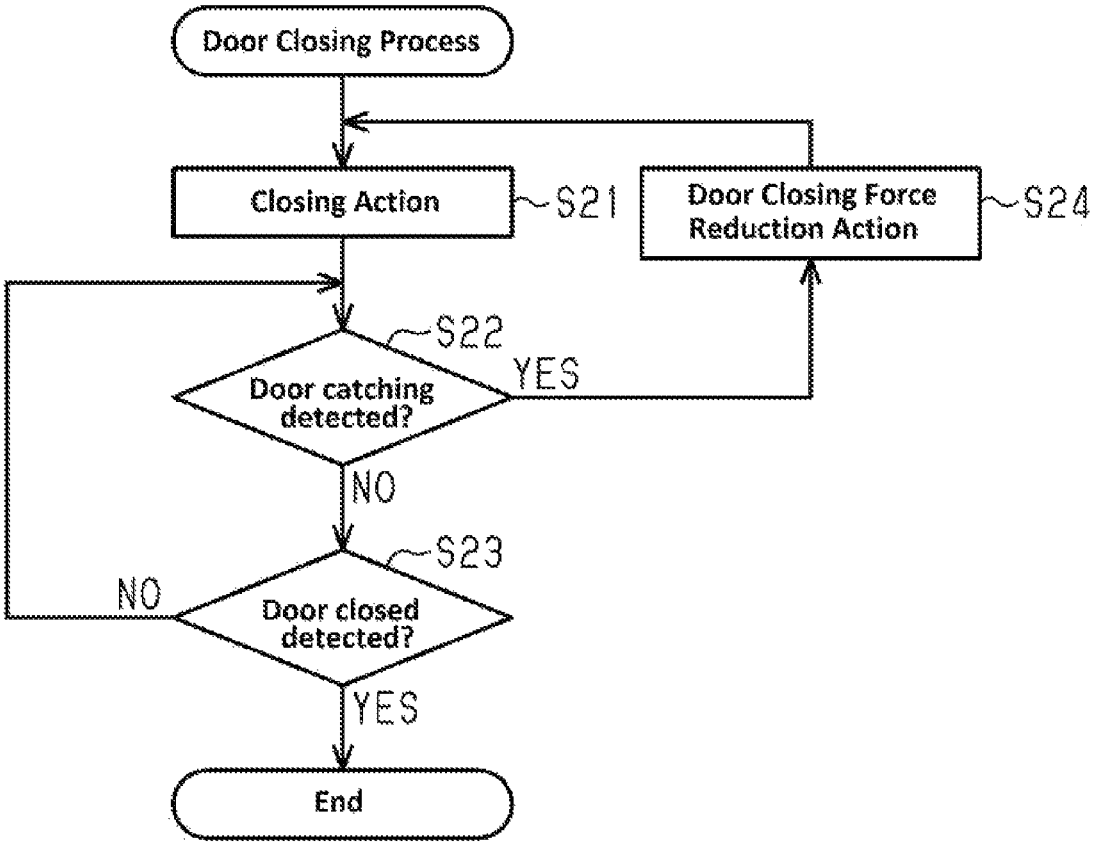
FIG. 9 is a flow chart showing a door closing process of the door driving device of the embodiment.

Referring to FIG. 9, the door control device 1 first performs a "closing action" (step S21). In the "closing action," the first switching valve 32 discharges the air from the first pressure chamber SC and the second switching valve 31 supplies the air to the second pressure chamber SH. That is, the door opening-closing unit 11 de-energizes the first switching valve 31 (OFF) and de-energizes the second switching valve 32 (OFF).

Figure 10:
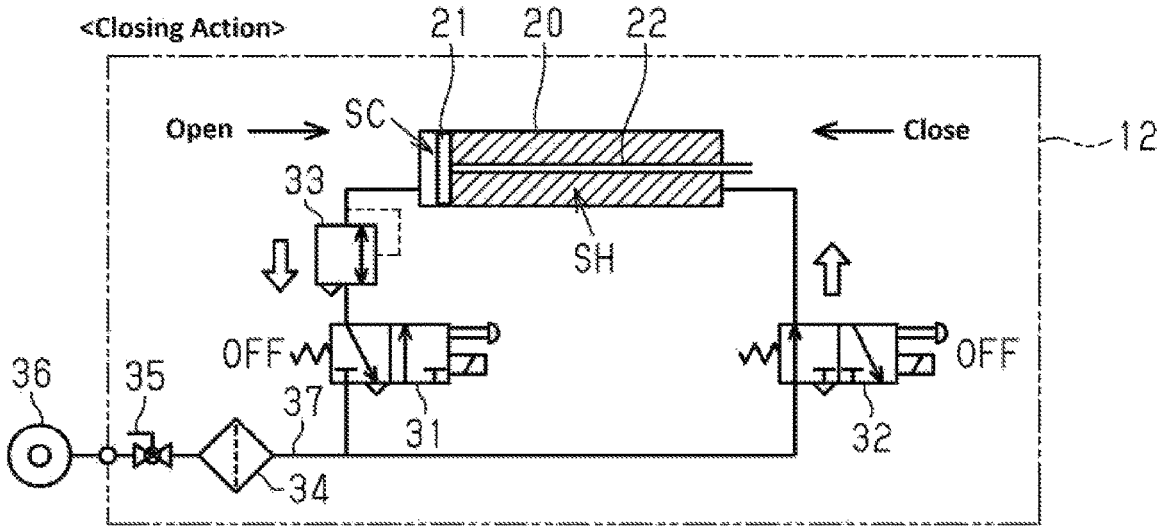
FIG. 10 is an air circuit diagram for describing a closing action performed by the door driving device of the embodiment.

As shown in FIG. 10, in the "closing action," the first switching valve 31 is de-energized (OFF) to discharge the air from the first pressure chamber SC, and the second switching valve 32 is de-energized (OFF) to supply the air to the second pressure chamber SH. Thus only the second pressure chamber SC side of the piston 21 is forced and moved in the closing direction.

As shown in FIG. 9, the door control device 1 then determines whether a door catching is detected (step S22). When the door opening-closing unit 11 determines that a door catching is detected (step S22: YES), the door opening-closing unit 11 performs a "door closing force reduction action" (step S24). In the "door closing force reduction action," the first switching valve 31 supplies the air to the first pressure chamber SC thereby reducing the door closing force after the "closing action" state. That is, the door opening-closing unit 11 energizes the first switching valve 31 (ON) and de-energizes the second switching valve 32 (OFF). After the "door closing force reduction action," the door opening-closing unit 11 proceeds to step S21.

Figure 11:
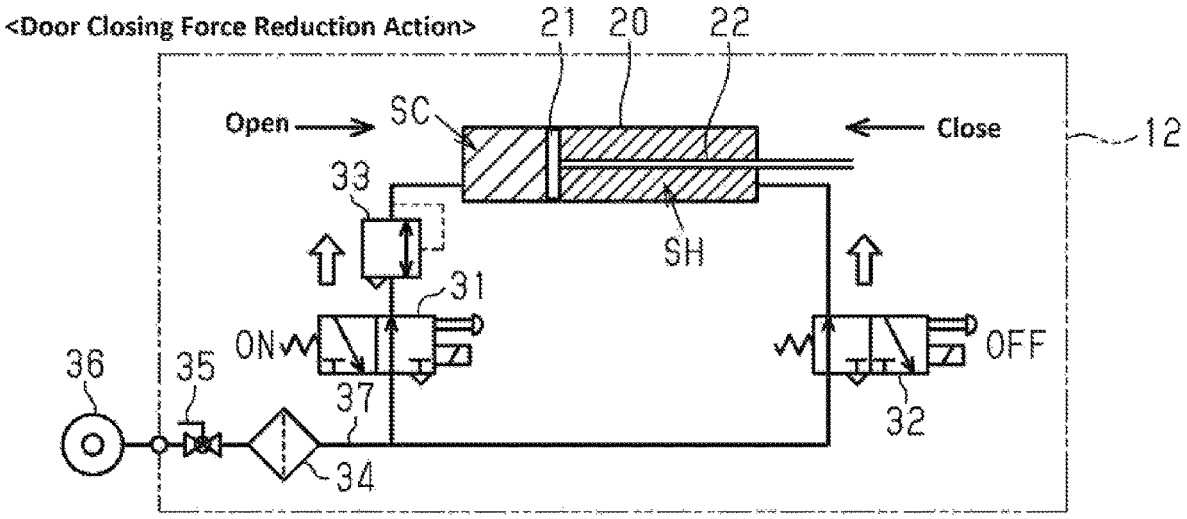
FIG. 11 is an air circuit diagram for describing a door closing force reduction action performed by the door driving device of the embodiment.

As shown in FIG. 11, in the "door closing force reduction action," the first switching valve 31 is energized (ON) to supply the air to the first pressure chamber SC, and the second switching valve 32 is de-energized (OFF) to supply the air to the second pressure chamber SH from the air source. Thus, the piston 21 is forced on both sides and the door closing force is reduced. Accordingly, it is possible to eliminate the door catching state.

Whereas when the door control device 1 determines that door catching is not detected (step S22: NO), the door control device 1 proceeds to step S23 and determines whether the door closed is detected (Step S23) as shown in FIG. 9. When the door opening-closing unit 11 determines that there is no detection of the door closed (step S23: NO), the door opening-closing unit 11 returns to step S22.

Whereas when the door control device 1 determines that there is detection of the door closed (step S23: YES), the door control device 1 operates a door closed lock to prevent the first door leaf 51 and the second door leaf 52 from moving and ends the door closing process.

As described above, the door driving device performs the "preliminary action" when the first door leaf 51 and the second door leaf 52 are opened by the pneumatic door driving unit 12 to allow passengers to easily notice that the door is about to open, and thereby it is possible to prevent passenger's finger from getting caught between the first door leaf 51 and the second door leaf 52 and the respective door case.

As described above, according to the embodiment, the following advantageous effects can be obtained.

(1) Since the first door leaf 51 and the second door leaf 52 move with discontinuous acceleration as the "preliminary action" when the first door leaf 51 and the second door leaf 52 are opened, passengers can easily notice opening of the first door leaf 51 and the second door leaf 52. Therefore, it is possible to prevent the occurrence of finger catching where an object or a finger gets caught between the first door leaf 51 and the second door leaf 52 and the corresponding door case.

(2) The "second action" that decelerates and stops the movement of the first door leaf 51 and the second door leaf 52 is included in the "preliminary action," which causes a change in the opening movement of the first door leaf 51 and the second door leaf 52. Consequently, it becomes easier for passengers to notice the opening movement of the first door leaf 51 and the second door leaf 52.

(3) Since the acceleration of the "first action" of the "preliminary operation" in the opening direction of the first door leaf 51 and the second door leaf 52 is larger than the acceleration of the normal opening action of the first door leaf 51 and the second door leaf 52 after the "second operation," passengers can easily notice the opening movement of the first door leaf 51 and the second door leaf 52.

(4) By using the cylinder 20 that moves the piston 21 via the first switching valve 31 and the second switching valve 32, opening and closing of the first door leaf 51 and the second door leaf 52 including the "preliminary action" are realized, and it is also possible to move the first door 51 and the second door 52 in the opening direction with discontinuous acceleration.

(5) Since the air in the second pressure chamber SH is exhausted before the "first action" of the "preliminary action," the first door leaf 51 and the second door leaf 52 can be moved with high acceleration by supplying the air to the first pressure chamber SC in the "first action" of the "preliminary action."

(6) In the "second action" of the "preliminary action," the air is discharged from the first pressure chamber SC that moves the first door leaf 51 and the second door leaf 52 in the opening direction, and the air is supplied to the second pressure chamber SH that moves the first door leaf 51 and the second door leaf 52 in the closing direction. Therefore, the "second action" in which the movement of the first door leaf 51 and the second door leaf 52 is decelerated and stopped can be performed in a short amount of time without hindering the movement of the piston in the "second action" of the "preliminary action."

(7) By providing the pressure reducing valve 33 between the first pressure chamber SC and the first switching valve 31, it is possible to make the force that moves the piston 21 in the closing direction larger than the force that moves the piston 21 in the opening direction. Therefore, even if the air is supplied to both the first pressure chamber SC and the second pressure chamber SH, the first door leaf 51 and the second door leaf 52 can be kept closed.

The foregoing embodiment can also be appropriately modified as described below.

In the above-described embodiment, in the "second action" after the "first action" of the "preliminary action," the second switching valve 32 is de-energized (OFF) to stop the movement of the piston 21 in the opening direction. However, in a case where the acceleration of the piston 21 in the opening direction is high in the "first action" so that it takes time to stop the movement of the piston, the movement of the piston 21 may be stopped in the same manner as the "fully closed state." More specifically, the first switching valve 31 may be de-energized (OFF) to discharge the air from the first pressure chamber SC and the second switching valve 32 may be de-energized (OFF) to supply the air to the second pressure chamber SH to stop the movement of the piston 21.

Although the "first action" (step S12) and the "second action" (step S13) are performed in the "preliminary action" in the above embodiment, another action in which the speed changes may be further added as the "preliminary operation."

In the above embodiment, the "preliminary action preparation" (step S11) may be omitted. When the "preliminary action preparation" is omitted, discharge of the air from the second pressure chamber SH is omitted. Thus, the acceleration of the piston 21 in the "first action" of the "preliminary action" is reduced. For example, as shown in FIG. 12, the acceleration of the "first action" of the first door leaf 51 and the second door leaf 52 is larger than the acceleration of the "normal opening action," but the speed of the "first action" of the first door leaf 51 and the second door 52 leaf is about same as the speed of "normal opening action."

Figure 12:
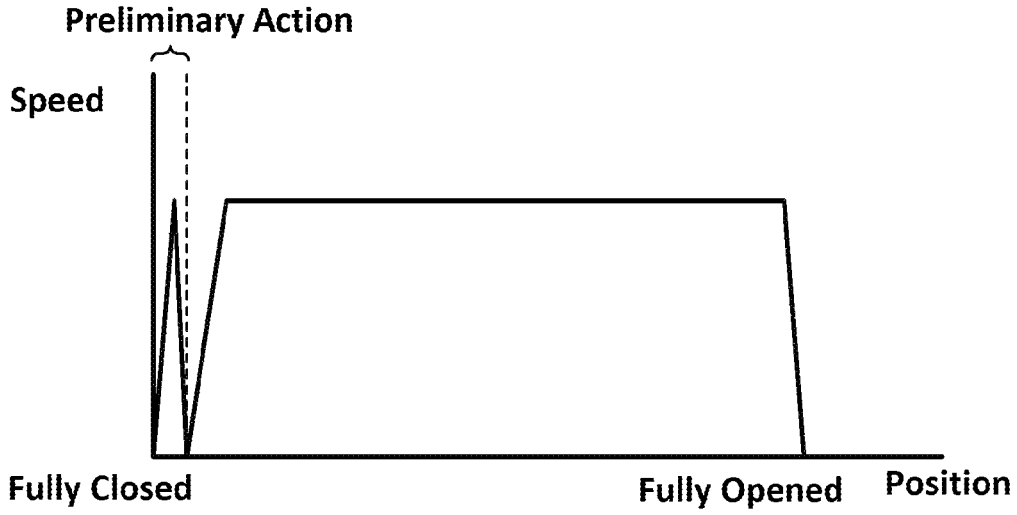
FIG. 12 is a graph showing change in the speed of the door opening process of the door driving device in a modification example.

In the above embodiment, the acceleration of the "first action" of the "preliminary action" is larger than the acceleration of the "normal opening action." However, the acceleration of the "first action" of the "preliminary action" may be equal to or less than the acceleration of the "normally opening action" as shown in FIG. 12.

Figure 13:
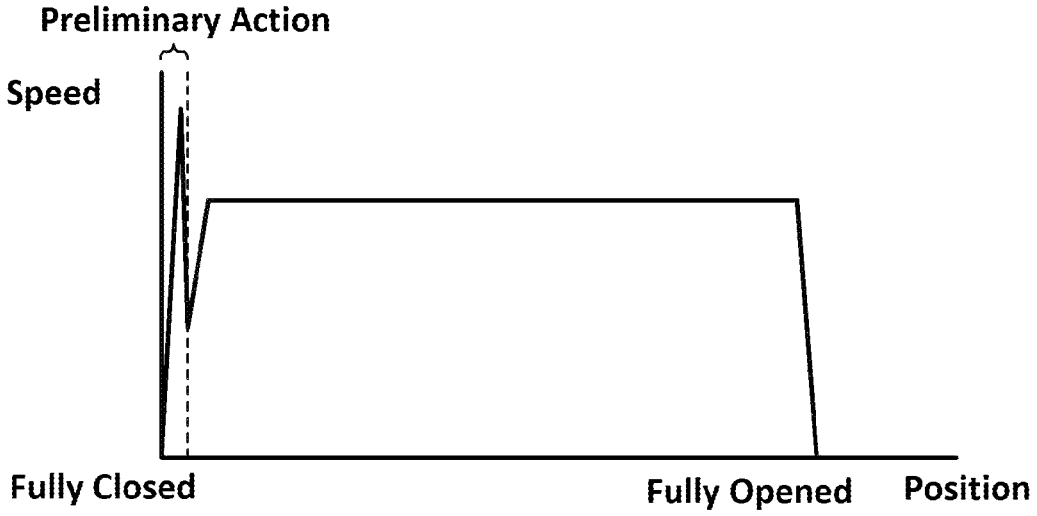
FIG. 13 is a graph showing change in the speed of the door opening process of the door driving device in a modification example.
Figure 14:
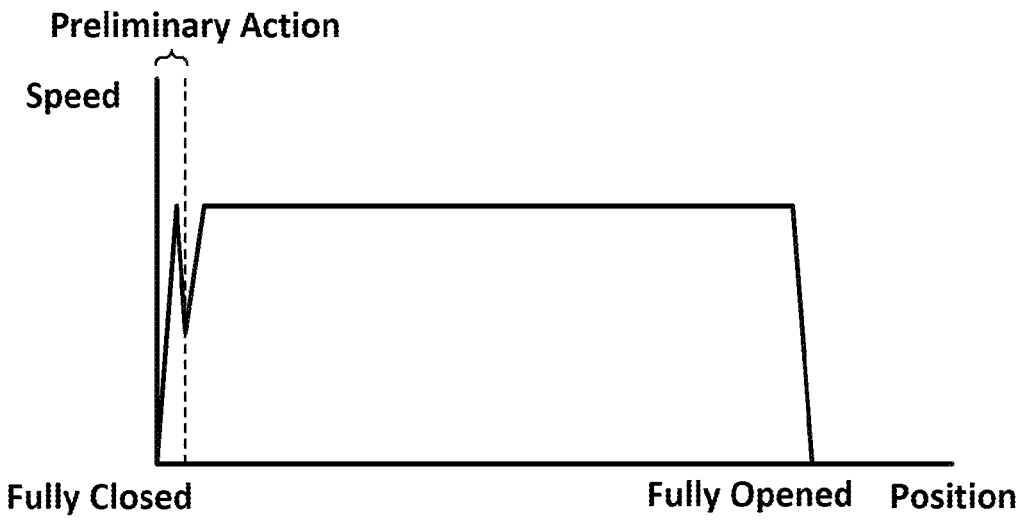
FIG. 14 is a graph showing change in the speed of the door opening process of the door driving device in a modification example.

In the above embodiment, the door leaves are decelerated and stopped in the "second action" of the "preliminary action" (step S13). Alternatively only deceleration of the door leaves may be performed as the "second action." For example, as illustrated in FIG. 13, when the "second action" is performed, the door opening-closing unit 11 may end the "second action" state before the first door leaf 51 and the second door leaf 52 are stopped and shift to the "normal opening action." For example, as illustrated in FIG. 14, the door opening-closing unit 11 may omit the "preliminary action preparation," end the "second action" state before the first door leaf 51 and the second door leaf 52 are stopped, and shift to the "normal opening action."

Figure 15:
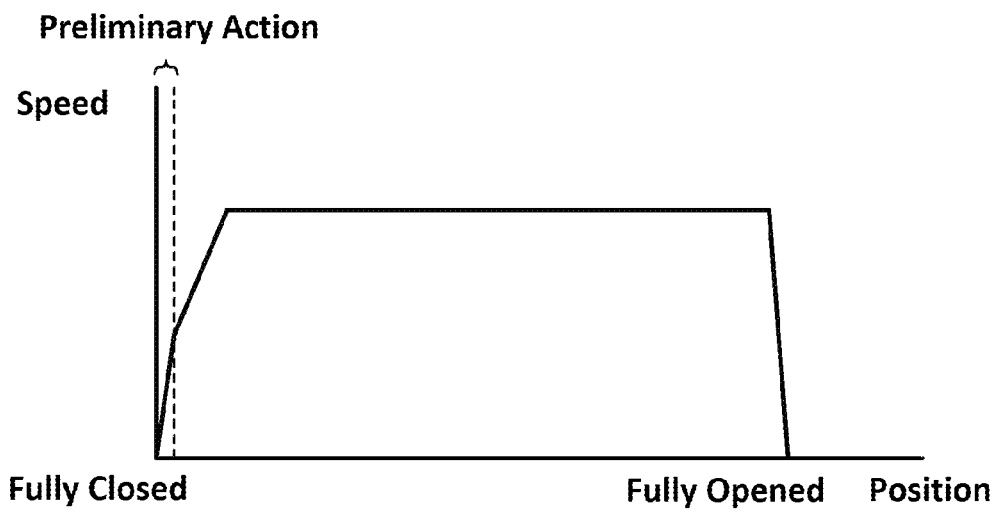
FIG. 15 is a graph showing change in the speed of the door opening process of the door driving device in a modification example.

In the above embodiment, the "second action" (step S13) is performed as the "preliminary action." Alternatively the "second action" (step S13) may be omitted and only the "first action" (step S12) may be performed as the "preliminary action." For example, at the rise of "normal opening action" as shown in FIG. 15, the door opening-closing unit 11 defines a section where an acceleration is higher than the acceleration of the "normal opening action" as the "first action" and thereafter shifts to the "normal opening action."

In the above embodiment, the first switching valve 31 and the second switching valve 32 are the valves each having three ports and two switching positions. However, provided that the piston 21 of the cylinder 20 is movable, the first switching valve 31 and the second switching valve 32 may be other type valves than the 3-port 2-position valves.

In the above configuration, the pressure reducing valve 33 may be omitted.

In the above embodiment, the air is supplied from the same air source 36 to the first pressure chamber SC and the second pressure chamber SH. Alternatively the first pressure chamber SC and the second pressure chamber SH may be supplied with air separately from different air sources. It is desirable that the piston 21 move in the closing direction when the air is supplied to both the first pressure chamber SC and the second pressure chamber SH.

In the above embodiment, the pneumatic cylinder is used as the door driving unit 12. Alternatively a hydraulic cylinder or the like may be employed instead of the pneumatic cylinder.

In the above embodiment, the pneumatic cylinder is used as the door driving unit 12. Alternatively a drive device such as an electric motor may be employed instead of the pneumatic cylinder. In the case where a drive device such as an electric motor is used, the door opening-closing unit 11 directly controls the drive device such as the electric motor such that the drive device performs the "preliminary action."

In the above embodiment, the door device 50 includes the door set consisting of the two door leaves, the first door leaf 51 and the second door leaf 52. Alternatively the door device may include a single-leaf door set.

In the above embodiment, the door control device 1 may have the function of the door catching detection device 2.

What is claimed is:

1. A door driving device, comprising:

a driving unit driving a door that opens and closes an entrance of a vehicle having a door case; and a control unit controlling the driving unit such that, during a period from when the door starts to open to when the door is retracted into the door case, the door moves in an opening direction in which the door is retracted into the door case with a discontinuous acceleration as a preliminary action instead of moving at a constant speed, and thereafter controlling the driving unit such that the door moves at a constant speed in the opening direction, wherein the control unit controls the driving unit such that the door is moved in the opening direction as a first action, and thereafter the control unit controls the driving unit such that the movement of the door is decelerated, stopped, or decelerated and stopped as a second action to thereby move the door with the discontinuous acceleration in the preliminary action.

2. A door driving device, comprising:

a driving unit driving a door that opens and closes an entrance of a vehicle having a door case; and a control unit controlling the driving unit such that the door moves with a discontinuous acceleration during a period from when the door starts to open to when the door moves at a constant speed in an opening direction in which the door is retracted into the door case, wherein the control unit controls the driving unit such that the door is moved in the opening direction as a first action, and thereafter the control unit controls the driving unit such that the movement of the door is decelerated, stopped, or decelerated and stopped as a second action thereby the door moves with the discontinuous acceleration, and wherein the control unit controls the driving unit such that an acceleration of the door in the opening direction in the first action is larger than an acceleration of the door in the opening direction after the second action is performed.

3. A door driving device, comprising:

a driving unit driving a door that opens and closes an entrance of a vehicle having a door case; and a control unit controlling the driving unit such that the door moves with a discontinuous acceleration during a period from when the door starts to open to when the door moves at a constant speed in an opening direction in which the door is retracted into the door case, wherein the control unit controls the driving unit such that the door is moved in the opening direction as a first action, and thereafter the control unit controls the driving unit such that the movement of the door is decelerated, stopped, or decelerated and stopped as a second action thereby the door moves with the discontinuous acceleration, wherein the driving unit includes:

a cylinder including a piston that drives the door to be opened or closed, a first pressure chamber that drives the piston such that the door is moved in the opening direction, and a second pressure chamber that drives the piston such that the door is moved in a closing direction opposite to the opening direction;

a first switching valve through which air is supplied to the first pressure chamber; and a second switching valve through which air is supplied to the second pressure chamber, wherein the control unit controls the driving unit such that the second switching valve discharges the air from the second pressure chamber while the first switching valve supplies the air to the first pressure chamber in order to move the door in the opening direction as the first action, and thereafter the control unit controls the driving unit such that the second switching valve supplies the air to the second pressure chamber in order to decelerate, stop, or decelerate and stop the movement of the door as the second action.

4. The door driving device of claim 3, wherein the control unit causes the first switching valve to discharge the air from the first pressure chamber and causes the second switching valve to discharge the air from the second pressure chamber before performing the first action.

5. The door driving device of claim 3, wherein the control unit causes the first switching valve to discharge the air from the first pressure chamber and causes the second switching valve to supply the air to the second pressure chamber when the movement of the door is decelerated, stopped, or decelerated and stopped as the second action.

6. The door driving device of claim 3, wherein air with a same pneumatic pressure is supplied to the first switching valve and the second switching valve, and wherein the driving unit further includes a pressure reducing valve that reduces a pressure of the air supplied to the first pressure chamber via the first switching valve.

* * * * *